US007503856B2

(12) United States Patent
Nardacci et al.

(10) Patent No.: US 7,503,856 B2
(45) Date of Patent: Mar. 17, 2009

(54) DIMPLE PATTERNS FOR GOLF BALLS

(75) Inventors: Nicholas M. Nardacci, Bristol, RI (US); William E. Morgan, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 37 days.

(21) Appl. No.: 11/211,538

(22) Filed: Aug. 26, 2005

(65) Prior Publication Data

US 2007/0049423 A1 Mar. 1, 2007

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS

| | | | | | |
|---|---|---|---|---|---|
| 5,044,638 | A | | 9/1991 | Nesbitt et al. | 273/232 |
| 5,149,100 | A | | 9/1992 | Melvin et al. | 273/232 |
| 5,377,989 | A | | 1/1995 | Machin | 273/232 |
| 5,562,552 | A | | 10/1996 | Thurman | 473/379 |
| 5,564,708 | A | * | 10/1996 | Hwang | 473/382 |
| 5,766,098 | A | * | 6/1998 | Molitor et al. | 473/377 |
| 5,957,786 | A | | 9/1999 | Aoyama | 473/379 |
| 6,010,442 | A | | 1/2000 | Lemons et al. | 484/378 |
| 6,290,615 | B1 | | 9/2001 | Ogg | 473/378 |
| 6,299,552 | B1 | | 10/2001 | Morgan et al. | 473/384 |
| 6,338,684 | B1 | | 1/2002 | Winfield et al. | 473/378 |
| 6,358,161 | B1 | | 3/2002 | Aoyama | 473/383 |
| 6,361,453 | B1 | | 3/2002 | Nakamura et al. | 473/371 |
| 6,394,912 | B1 | | 5/2002 | Nakamura et al. | 473/371 |
| 6,431,998 | B1 | | 8/2002 | Nakamura et al. | 473/371 |
| 6,461,253 | B2 | | 10/2002 | Ogg | 473/378 |
| 6,533,684 | B2 | | 3/2003 | Winfield et al. | 473/378 |
| 6,669,143 | B1 | | 12/2003 | Johnson | 244/122 |
| 6,682,441 | B2 | | 1/2004 | Winfield et al. | 473/378 |
| 6,682,442 | B2 | | 1/2004 | Winfield | 473/383 |
| 6,729,976 | B2 | | 5/2004 | Bissonnette et al. | 473/383 |
| 6,749,525 | B2 | | 6/2004 | Aoyama | 473/383 |
| 6,849,007 | B2 | | 2/2005 | Morgan et al. | 473/378 |
| 2005/0137032 | A1 | | 6/2005 | Aoyama et al. | |

* cited by examiner

*Primary Examiner*—Raeann Trimiew
(74) *Attorney, Agent, or Firm*—Hanify & King, P.C.

(57) ABSTRACT

A golf ball dimple pattern based on a hexagonal dipyramid polyhedron is disclosed. Preferably, the dimple pattern disclosed by the present invention includes dimples that are arranged such that at least a portion of neighboring dimples have one or more predetermined diameter ratios. The dimples are arranged based on six substantially similar mating dimple sections on each hemisphere. Each of the six substantially similar mating dimple sections on each hemisphere share a dimple positioned at the pole of that hemisphere. The dimple pattern is capable of achieving a surface coverage of about 82% or greater.

24 Claims, 9 Drawing Sheets

DIMPLE PATTERNS FOR GOLF BALLS

FIELD OF THE INVENTION

The present invention relates to dimple patterns that are defined by hexagonal dipyramid polyhedra. More specifically, the present invention relates to an apparatus and method for arranging dimples such that at least a portion of neighboring dimples have predetermined diameter ratios.

BACKGROUND OF THE INVENTION

Historically, dimple patterns for golf balls have had an enormous variety of geometric shapes, patterns, and configurations. Primarily, patterns are laid out in order to provide desired performance characteristics based on the particular ball construction, material attributes, and player characteristics influencing the ball's initial launch angle and spin conditions. Therefore, pattern development is a secondary design step that is used to achieve the appropriate aerodynamic behavior, thereby tailoring ball flight characteristics and performance.

Aerodynamic forces generated by a ball in flight are a result of its velocity and spin. These forces, which overcome the force of gravity, are lift and drag. Lift force is perpendicular to the direction of flight and is a result of air velocity differences above and below the rotating ball. This phenomenon is attributed to Magnus and described by Bernoulli's Equation, a simplification of the first law of thermodynamics.

Bernoulli's equation relates pressure and velocity where pressure is inversely proportional to the square of velocity. The velocity differential, due to faster moving air on top and slower moving air on the bottom, results in lower air pressure on top and an upward directed force on the ball. Drag is opposite in sense to the direction of flight and orthogonal to lift. The drag force on a ball is attributed to parasitic drag forces, which consist of form or pressure drag and viscous or skin friction drag. A sphere is a bluff body, which is an inefficient aerodynamic shape. As a result, the accelerating flow field around the ball causes a large pressure differential with high-pressure forward and low-pressure behind the ball. In order to minimize pressure drag, dimples provide a means to energize the flow field and delay the separation of flow, or reduce the low-pressure region behind the ball. However, the penalty for reducing pressure drag is skin friction. Skin friction is a viscous effect residing close to the surface of the ball within the boundary layer. The dimples provide an optimal amount of disturbance, triggering the laminar turbulent flow transition while maintaining a sufficiently thin boundary layer region for viscous drag to occur.

The United States Golf Association (U.S.G.A.) requires that golf balls have aerodynamic symmetry. Aerodynamic symmetry allows the ball to fly with a very small amount of variation no matter how the golf ball is placed on the tee or ground. Preferably, dimples cover the maximum surface area of the golf ball without detrimentally affecting the aerodynamic symmetry of the golf ball.

Many dimple patterns are based on geometric shapes. These may include circles, hexagons, triangles, and the like. Other dimple patterns are based in general on three of five existing Platonic Solids including Icosahedron, Dodecahedron, or Octahedron. Furthermore, other dimple patterns are based on hexagonal dipyramids. Because the number of symmetric solid plane systems is limited, it is difficult to devise new symmetric patterns. Moreover, dimple patterns based some of these geometric shapes result in less than optimal surface coverage and other disadvantageous dimple arrangements. Therefore, dimple properties such as number, shape, size, and arrangement are often manipulated in an attempt to generate a golf ball that has better aerodynamic properties.

A continuing need exists for a dimple pattern whose dimple arrangement results in a maximized surface coverage and desirable aerodynamic characteristics.

SUMMARY OF THE INVENTION

According to one aspect, the present invention comprises a golf ball surface that includes two hemispheres, each having a pole. The two hemispheres are preferably divided by an equator positioned midway between the poles. The golf ball surface includes a dimple positioned at each pole and six substantially similar mating dimple sections located on each hemisphere. It is desirable for each dimple section to have a dimple pattern comprising dimples selectively positioned such that at least a portion of nearest neighbor dimples have diameter ratios of about 1.5 or greater.

In one embodiment, the six substantially similar mating dimple sections on each side of the equator share the dimple positioned at each pole. The dimple pattern preferably has a surface coverage of about 82% or more, and comprises between about 250 and about 475 dimples. In another embodiment, the nearest neighbor dimples may have diameter ratios of about 1.8 or greater.

With regard to the dimple distribution, at least a portion of nearest neighbor dimples comprising a diameter ratio of about 1.5 or greater are selectively positioned around an area of each dimple section located midway between the equator and the pole of each of the two hemispheres. When arranged in this manner, the golf ball comprises a plurality of dimples having an aerodynamic coefficient magnitude defined by $C_{mag}=\sqrt{(C_L^2+C_D^2)}$ and an aerodynamic force angle defined by $\text{Angle}=\tan^{-1}(C_L/C_D)$, where $C_L$ is a lift coefficient and $C_D$ is a drag coefficient. In this embodiment, the golf ball comprises a first aerodynamic coefficient magnitude between about 0.25 and about 0.28 and a first aerodynamic force angle between about 28 degrees and about 40 degrees at a Reynolds Number of about 230000 and a spin ratio of about 0.080. In addition, the golf ball includes a second aerodynamic coefficient magnitude between about 0.26 and about 0.29 and a second aerodynamic force angle between about 29 degrees and about 41 degrees at a Reynolds Number of about 208000 and a spin ratio of about 0.090.

It may be desirable for the golf ball to further comprise a third aerodynamic coefficient magnitude between about 0.26 and about 0.30 and a third aerodynamic force angle between about 30 degrees and about 42 degrees at a Reynolds Number of about 190000 and a spin ratio of about 0.10. Moreover, a fourth aerodynamic coefficient magnitude may be between about 0.27 and about 0.32 and a fourth aerodynamic force angle may be between about 31 degrees and about 44 degrees at a Reynolds Number of about 170000 and a spin ratio of about 0.11.

According to another aspect, the present invention comprises a method for arranging dimples on the surface of a golf ball where the golf ball includes two hemispheres, each having a pole. The two hemispheres are preferably divided by an equator located midway between the poles. In one embodiment, the method comprises positioning a dimple at the pole of each hemisphere and arranging a plurality of dimples in a substantially similar manner within each of six identical substantially mating dimple sections positioned on each side of the equator. It is desirable for the plurality of dimples comprises at least some dimples having one or more predetermined nearest neighbor diameter ratios. Moreover, the plurality of dimples are arranged such that they have a surface coverage of about 80% or greater. In other embodiments, the plurality of dimples may be arranged such that they have a surface coverage of about 85% or greater. The number of dimples may comprise, for example, between about 250 and about 475 dimples.

In one embodiment, the dimples may be arranged such that the one or more predetermined nearest neighbor diameter ratios are about 1.5 or greater. Alternately, the one or more predetermined nearest neighbor diameter ratios may be between about 1.5 and about 1.8. Preferably, the dimples having these nearest neighbor diameter ratios are not positioned near the pole or equator of the golf ball.

It is desired that the golf ball comprises a plurality of dimples having an aerodynamic coefficient magnitude defined by $C_{mag}=\sqrt{(C_L^2+C_D^2)}$ and an aerodynamic force angle defined by $\text{Angle}=\tan^{-1}(C_L/C_D)$, wherein $C_L$ is a lift coefficient and $C_D$ is a drag coefficient. Preferably, the golf ball has a first aerodynamic coefficient magnitude between about 0.25 and about 0.28 and a first aerodynamic force angle between about 28 degrees and about 40 degrees at a Reynolds Number of about 230000 and a spin ratio of about 0.080. Additionally, the golf ball has a second aerodynamic coefficient magnitude between about 0.26 and about 0.29 and a second aerodynamic force angle between about 29 degrees and about 41 degrees at a Reynolds Number of about 208000 and a spin ratio of about 0.090.

In some embodiments, the golf ball may also have a third aerodynamic coefficient that has a magnitude between about 0.26 and about 0.30 and a third aerodynamic force angle between about 30 degrees and about 42 degrees at a Reynolds Number of about 190000 and a spin ratio of about 0.10. Furthermore, a fourth aerodynamic coefficient magnitude may be between about 0.27 and about 0.32 and a fourth aerodynamic force angle may be between about 31 degrees and about 44 degrees at a Reynolds Number of about 170000 and a spin ratio of about 0.11.

According to yet another aspect, the present invention comprises a method for arranging dimples on the surface of a golf ball that includes two hemispheres, each having a pole. Additionally, the hemispheres are preferably divided by an equator located midway between the poles. Preferably, the method includes positioning a dimple at the pole of each hemisphere and generating a dimple arrangement for a plurality of dimples within each of six similar substantially mating dimple sections positioned on each hemisphere. The six similar substantially mating dimple sections positioned on each hemisphere share the dimple positioned at the pole of the hemisphere. Moreover, the plurality of dimples comprises at least some dimples selectively positioned based on one or more predetermined nearest neighbor diameter ratios.

In one embodiment, the one or more predetermined nearest neighbor diameter ratios are between about 1.5 and about 2. Moreover, the plurality of dimples comprises a surface coverage of at least about 82%. At least some of the dimples selectively positioned based on one or more predetermined nearest neighbor diameter ratios are not positioned near the pole or near the equator.

The golf ball may comprise a plurality of dimples having an aerodynamic coefficient magnitude defined by $C_{mag}=\sqrt{(C_L^2+C_D^2)}$ and an aerodynamic force angle defined by $\text{Angle}=\tan^{-1}(C_L/C_D)$, wherein $C_L$ is a lift coefficient and $C_D$ is a drag coefficient. The golf ball comprises a first aerodynamic coefficient magnitude between about 0.25 and about 0.28 and a first aerodynamic force angle between about 28 degrees and about 40 degrees at a Reynolds Number of about 230000 and a spin ratio of about 0.080. A second aerodynamic coefficient magnitude may be between about 0.26 and about 0.29 and a second aerodynamic force angle may be between about 29 degrees and about 41 degrees at a Reynolds Number of about 208000 and a spin ratio of about 0.090.

Moreover, the golf ball may have a third aerodynamic coefficient magnitude between about 0.26 and about 0.30 and a third aerodynamic force angle between about 30 degrees and about 42 degrees at a Reynolds Number of about 190000 and a spin ratio of about 0.10. Finally, the golf ball may also include a fourth aerodynamic coefficient magnitude between about 0.27 and about 0.32 and a fourth aerodynamic force angle between about 31 degrees and about 44 degrees at a Reynolds Number of about 170000 and a spin ratio of about 0.11.

BRIEF DESCRIPTION OF THE DRAWINGS

Further features and advantages of the invention can be ascertained from the following detailed description that is provided in connection with the drawings described below.

DETAILED DESCRIPTION OF THE PREFERRED EMBODIMENTS

Figure 1:
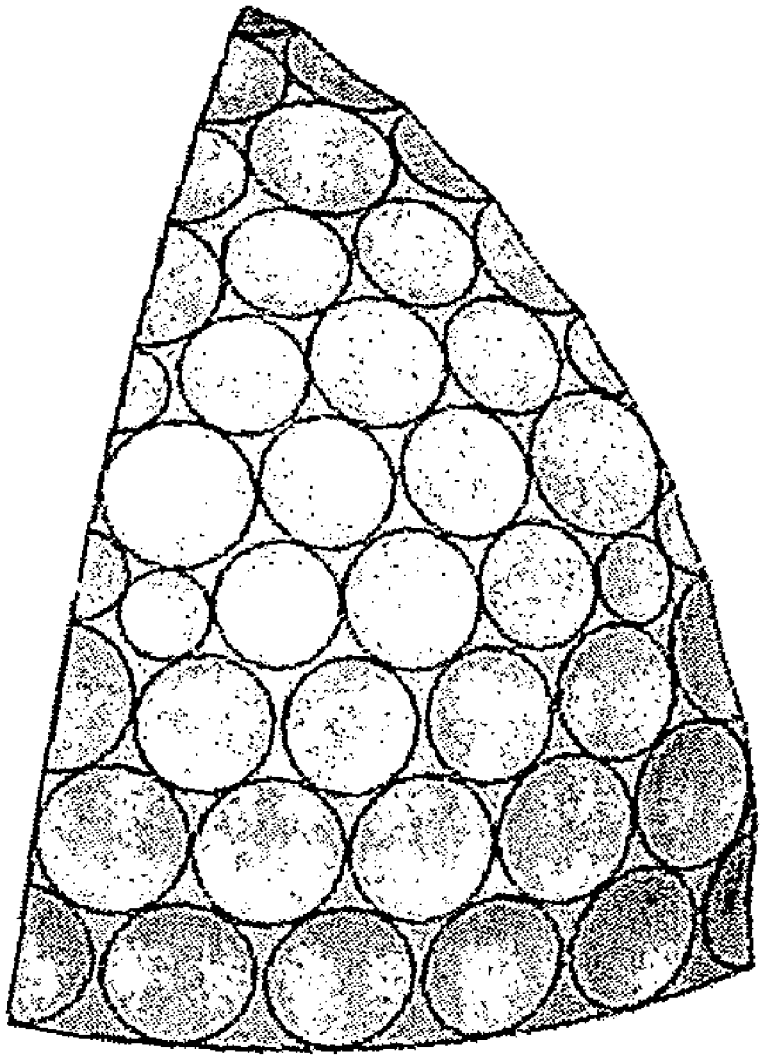
FIG. 1 is a diagram showing an exemplary section according to one embodiment of the present invention.

Dimple patterns may be based on polyhedra having a variety of shapes. One example of a polyhedron on which dimple patterns have been based is a hexagonal dipyramid polyhedron. Although there are some known dimple patterns based on hexagonal dipyramid polyhedra, they are unable to achieve the surface coverage disclosed by the present invention. Moreover, known dimple patterns do not have the novel dimple arrangement described below.

The present invention relates to a dimple pattern that may be used on a substantially spherical object, such as a golf ball and the like. It is desirable for the dimple pattern to be defined by, for example, a hexagonal dipyramid polyhedron. Though the present invention is discussed with respect to hexagonal dipyramid polyhedra, it will be understood that the dimple pattern of the present invention may be based on other polyhedra, geometrical shapes, or Platonic Solids known to those skilled in the art. Preferably, the dimple pattern disclosed by the present invention includes dimples that are arranged such that at least a portion of neighboring dimples have predetermined diameter ratios. It may also be desirable for the dimple pattern to comprise a shared polar dimple. The polar dimple may be shared by at least six substantially similar mating dimple sections on each hemisphere. Thus, the entire ball comprises twelve substantially similar mating sections.

In an exemplary embodiment, the dimple pattern disclosed by the present invention may be used with any type of spherical ball. Preferably, however, the dimple pattern is used on the surface of a golf object, such as a golf ball. The golf ball may be constructed in any manner known to those skilled in the art. For example, the golf ball may have any type of core, such as solid, liquid, wound, and the like. Additionally, the golf ball may be one-piece, two-piece, or may have multiple pieces. The various pieces of the golf ball may be constructed from any suitable material known to those skilled in the art, such as polybutadiene and the like. Furthermore, the cover may be constructed from any material, such as a urethane, Surlyn®, and the like. When desirable, the cover may be coated with any number of layers, such as a base coat, top coat, paint, or any other desired coating. As will be appreciated by those skilled in the art, any manufacturing technique may be used to construct the various portions of the golf ball.

Though the present invention includes substantially circular dimples in one embodiment, dimples or protrusions (brambles) having any desired characteristics and/or properties may be used. For example, in one embodiment the dimples may have a variety of shapes and sizes including different depths and widths. In particular, the dimples may be concave hemispheres, or they may be triangular, square, hexagonal, catenary, polygonal or any other shape known to those skilled in the art. They may also have straight, curved, or sloped edges or sides. To summarize, any type of dimple or protrusion (bramble) known to those skilled in the art may be used with the present invention.

In one embodiment, the dimple pattern is generated using a computer that includes a processor and memory. Preferably, the processor executes computer program instructions that are stored on a computer readable medium. Moreover, it is desirable for the processor to be capable of running a computer modeling program that is capable of generating dimple patterns. Preferably, the computer modeling program generates one or more dimple patterns based on input parameters. Exemplary input parameters may include, but are not limited to, the shape of the polyhedron on which a dimple pattern is based, the number of different dimple diameters, the number of dimples, the number of differently sized dimples, dimple properties (as described above), desired surface coverage, dimple overlap, and the like.

Figure 2:
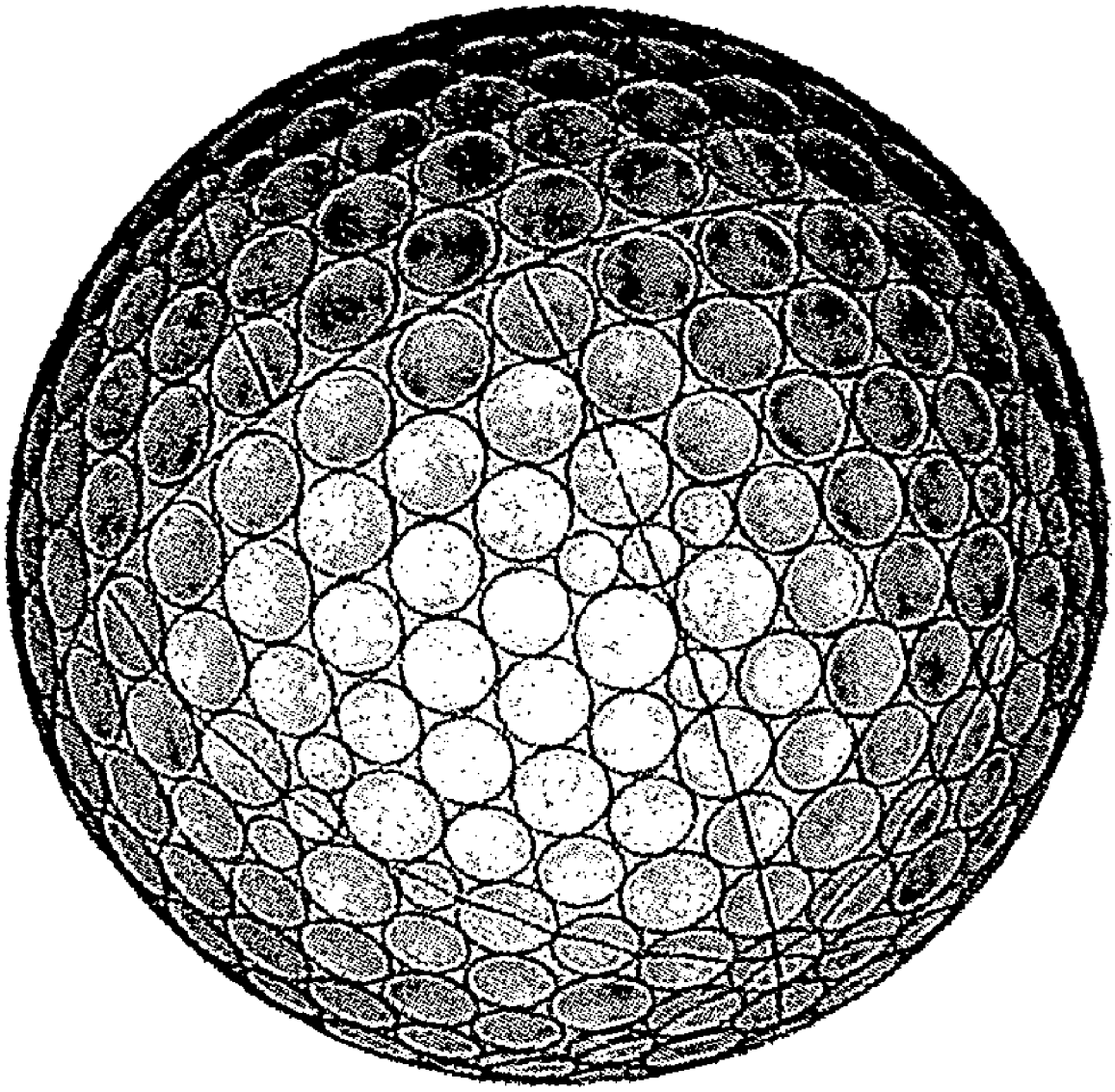
FIG. 2 is a diagram showing mating sections according to the exemplary section shown in FIG. 1.
Figure 3:
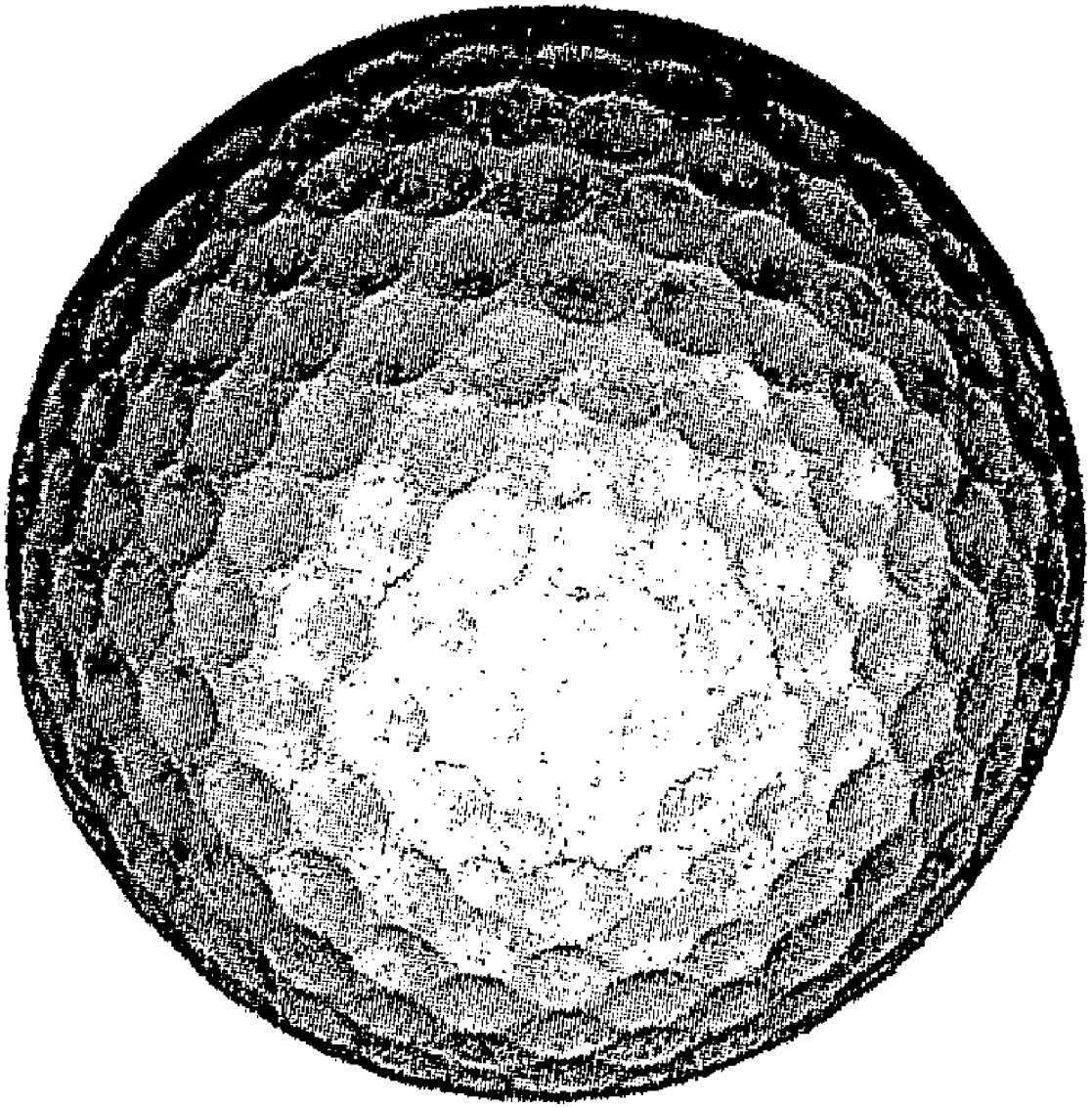
FIG. 3 is a diagram showing an exemplary dimple pattern for a golf ball according to the section shown in FIG. 1.

According to one aspect of the present invention, the dimple pattern is based on a hexagonal dipyramid polyhedron. In one embodiment, each hemisphere of the golf ball preferably has six identical substantially mating dimple sections, an example of which is shown in FIG. 1. However, in other embodiments each of the mating dimple sections may be substantially similar, but include small variations. In one embodiment, a dimple pattern is preferably generated for one of the six identical sections. A dimple pattern that is substantially similar to the dimple pattern of the section may then be repeated in each of the other eleven sections of the golf ball, as shown in FIG. 2. In this manner, a dimple pattern for the entire golf ball may be achieved, as shown in FIG. 3.

Figure 4:
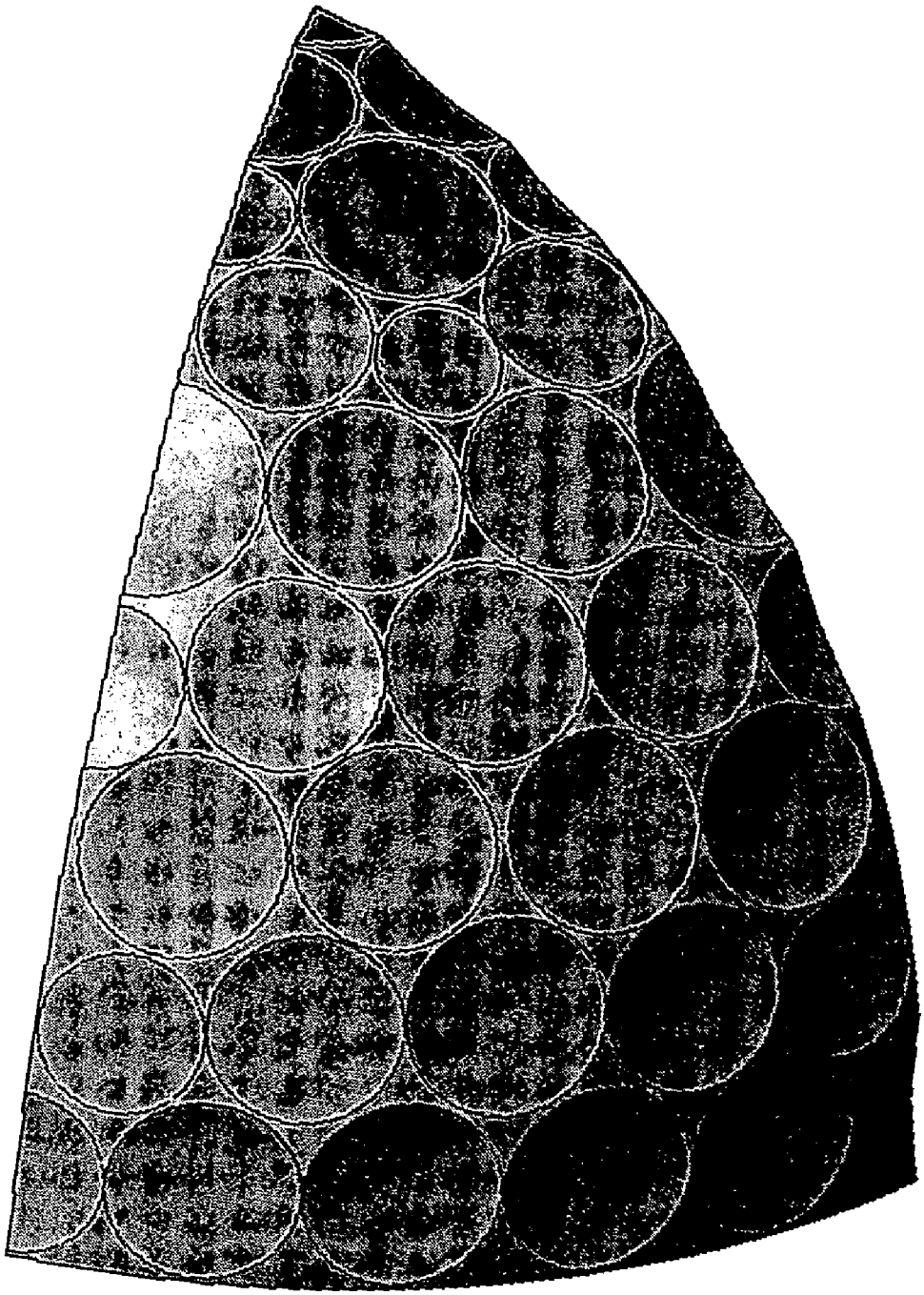
FIG. 4 is a diagram showing an exemplary section according to another embodiment of the present invention.
Figure 5:
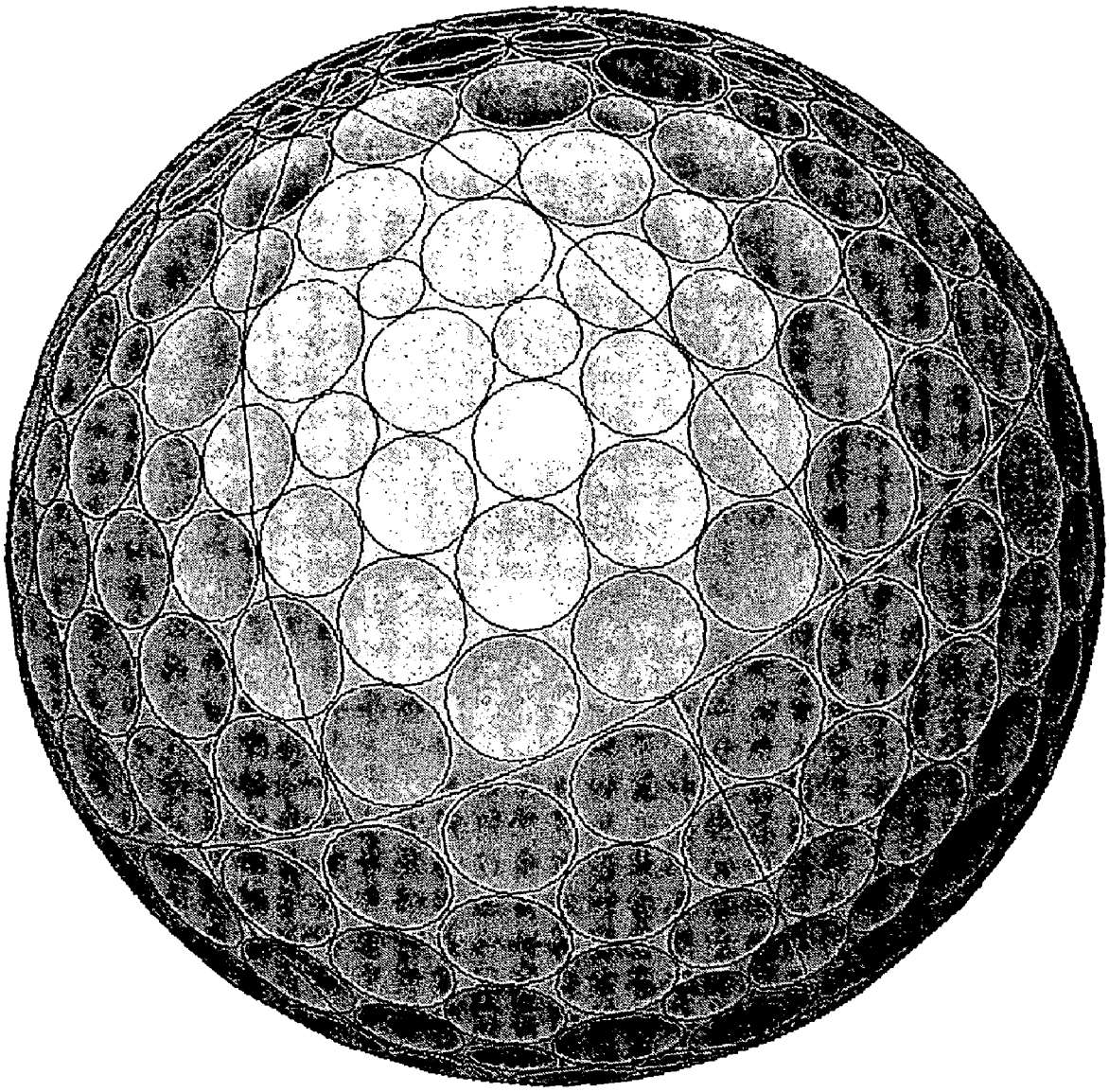
FIG. 5 is a diagram showing mating sections according to the exemplary section shown in FIG. 4.
Figure 6:
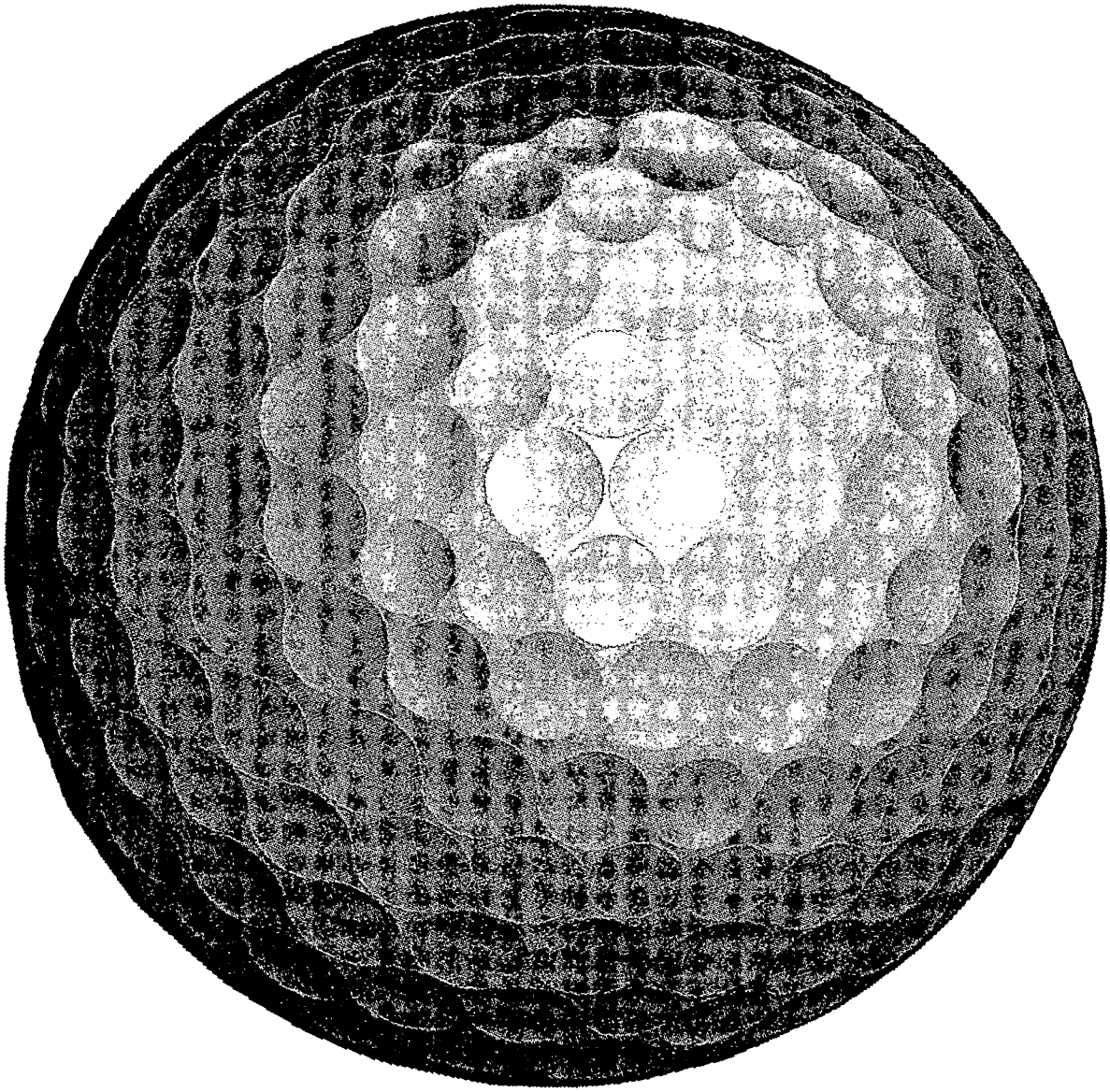
FIG. 6 is a diagram showing an exemplary dimple pattern for a golf ball according to the section shown in FIG. 4.
Figure 7:
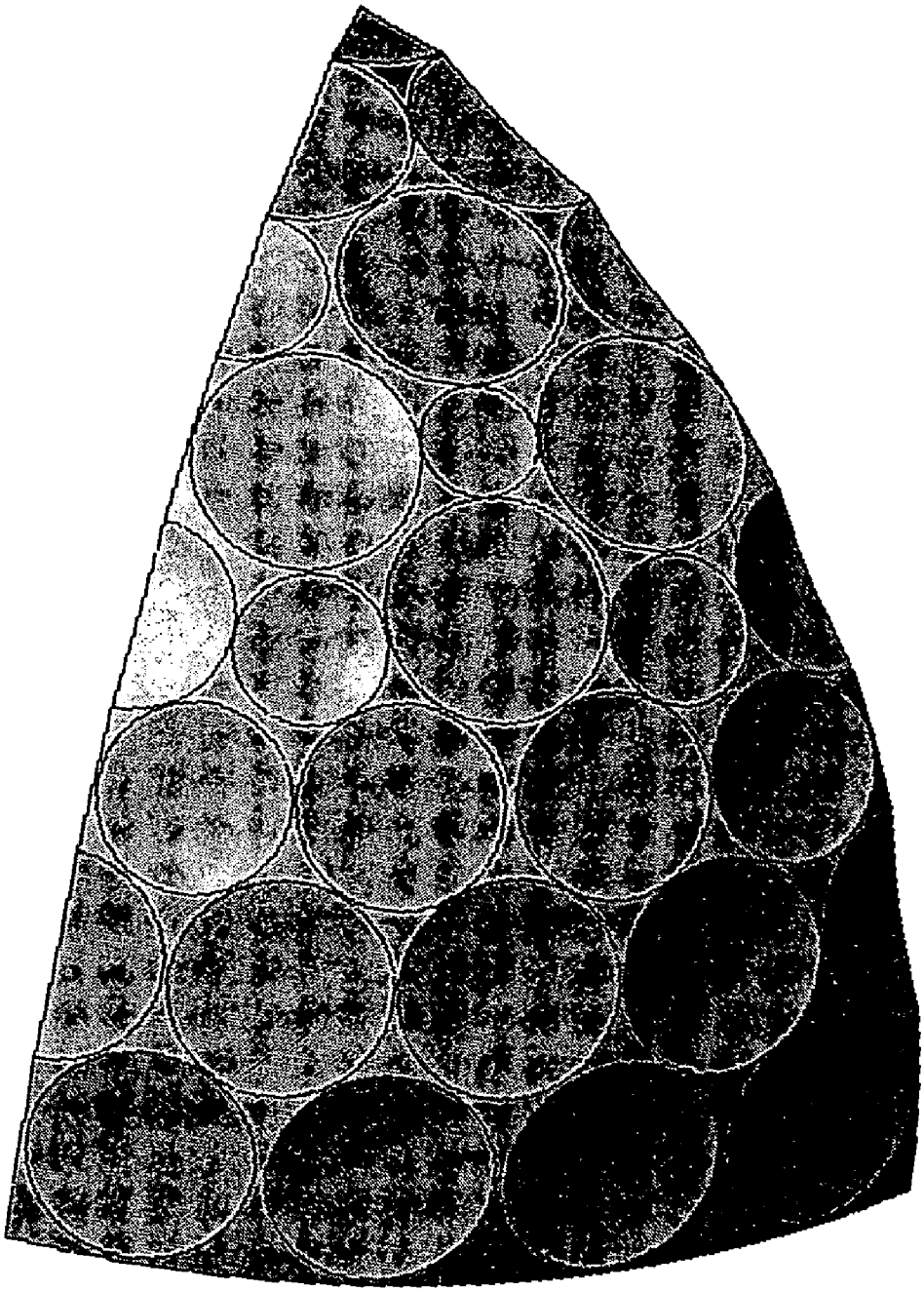
FIG. 7 is a diagram showing an exemplary section according to yet another embodiment of the present invention.
Figure 8:
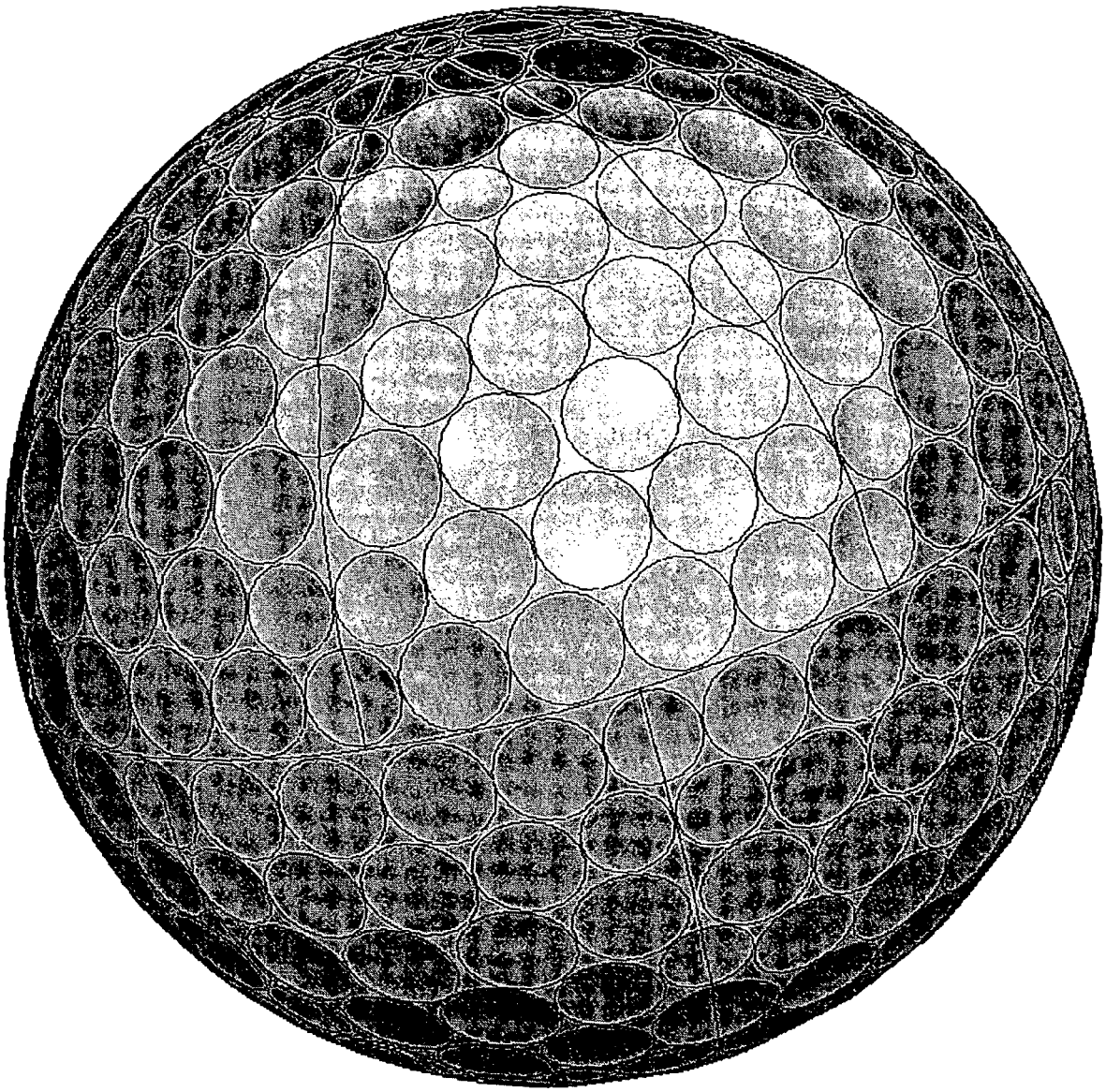
FIG. 8 is a diagram showing mating sections according to the exemplary section shown in FIG. 7.
Figure 9:
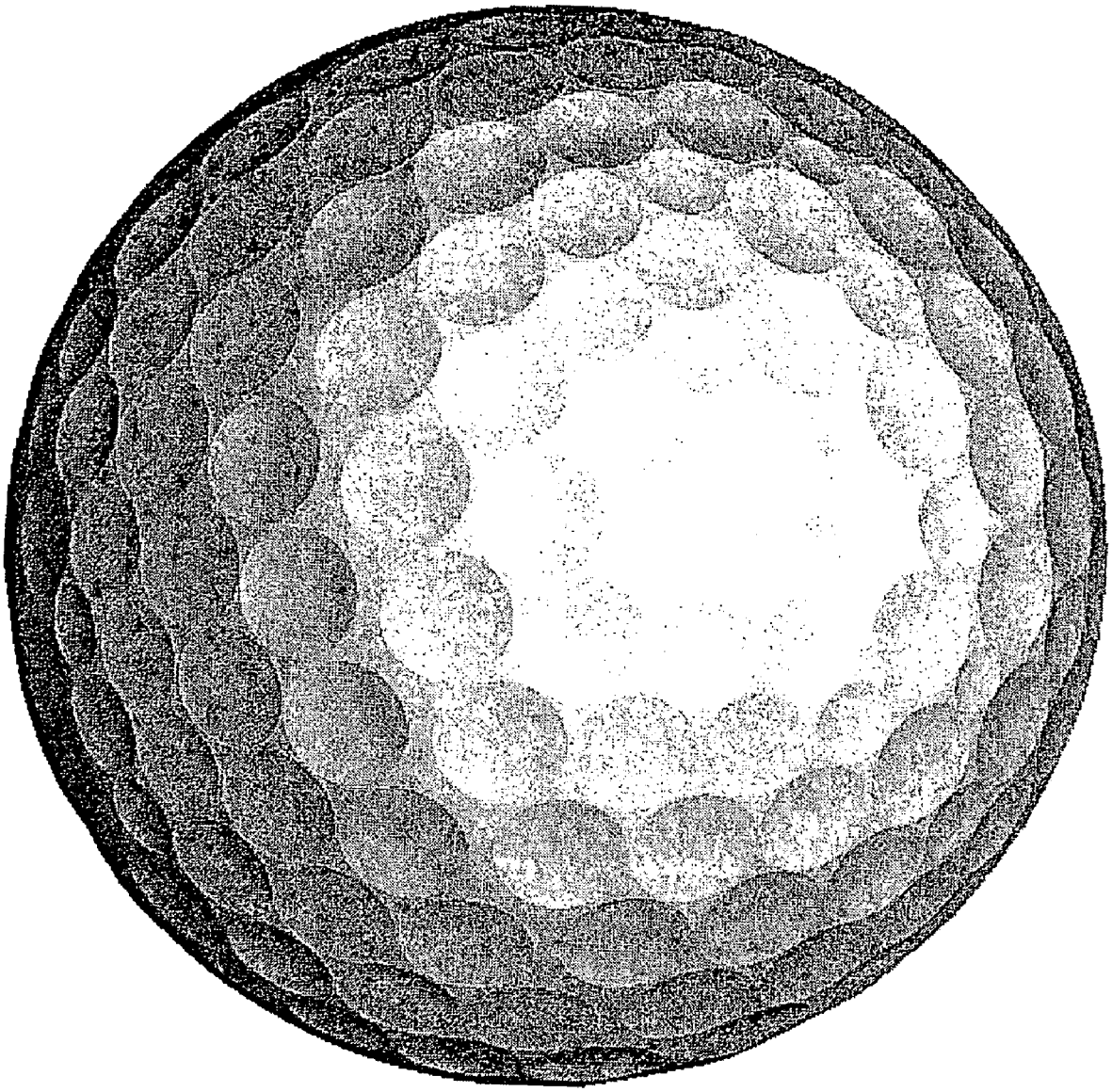
FIG. 9 is a diagram showing an exemplary dimple pattern for a golf ball according to the section shown in FIG. 7.

In other embodiments, the dimple patterns may include any number of dimples. In these embodiments, the dimple pattern may also be based on, for example, a hexagonal dipyramid polyhedron. One exemplary dimple section, mating sections based on the dimple section, and a dimple pattern for a golf ball based on the dimple section are shown in FIGS. 4-6, respectively. Yet another exemplary dimple section, mating sections based on the exemplary dimple section, and a dimple pattern for a golf ball based on the dimple section are shown in FIGS. 7-9, respectively.

In one embodiment, the dimple pattern is generated such that each section shares a polar dimple. In other words, a single dimple is shared by each of the six mating sections that cover a hemisphere of the golf ball. Thus, each of the six mating sections on each hemisphere comprises approximately one-sixth of the polar dimple. After the shared polar dimple has been positioned, the remaining dimples for a section may be arranged to form a dimple pattern. The dimple arrangement may be generated in any desired manner based on, for example, one or more mathematical algorithms, circle packing theory, Soddy circles, and the like. Alternately, the dimple arrangement may be determined according to the science of phyllotaxis, which involves the study of symmetrical patterns or arrangements. One example of dimple patterns determined based on phyllotaxis is disclosed in U.S. Pat. No. 6,699,143, entitled "Phyllotaxis-Based Dimple Patterns," the entirety of which is incorporated herein by reference. Once the dimple pattern has been generated, it is preferably repeated in each of the eleven additional sections located on the golf ball. This provides the advantage of generating a dimple arrangement that has hemispherical symmetry, thereby resulting in optimal aerodynamic performance.

As mentioned above, the dimple pattern may be generated based on a computer modeling program. In one embodiment, it is desirable for the computer modeling program to generate the dimple pattern such that it achieves maximal dimple coverage for the golf ball. In this respect, the computer modeling program may be capable of varying, for example, the number, diameter, and number of differently sized dimples in order to achieve an optimal dimple coverage. The computer modeling program may be based on one or more mathematical algorithms. The mathematical algorithms may be used to determine a dimple arrangement based on circle packing theory, Soddy circles, phyllotaxis, and the like.

It may be desirable to predefine the maximum dimple diameter in one embodiment. However, in other embodiments it may be preferable to allow the computer modeling program to generate a dimple pattern without predefined sizes. In such an embodiment, the dimple pattern may be altered by a user if it results in dimple diameters that are undesirable. However, in embodiments where it is desirable to predefine a maximum dimple diameter, the maximum may be input into the computer modeling program. One advantage of having a maximum dimple diameter is that the aerodynamic characteristics of the golf ball, such as the coefficient of lift and drag, may be increased. Preferably, the maximum dimple diameter is about 0.22 inches or less. More preferably, the maximum dimple diameter is about 0.20 inches or less, and most preferably the maximum dimple diameter is about 0.18 inches or less.

Similarly, in some embodiments it may be desirable for the minimum dimple diameter to be predefined. Very small dimple diameters may also adversely affect the aerodynamic characteristics of a golf ball, making them undesirable. Moreover, dimples are often formed by molds, which have protrusions that cause dimples to be formed in a cover material. Having dimples whose diameters are too small may make a mold difficult to manufacture, which can increase cost and errors, and therefore decrease efficiency. Accordingly, the minimum dimple diameter is preferably about 0.06 inches or greater. More preferably, the minimum dimple diameter is about 0.07 inches or greater, and most preferably the minimum dimple diameter is about 0.08 inches or greater.

The number of differently sized dimples may be varied as desired. In some embodiments, it may be preferable to limit the number of different sizes of dimples. Having too many differently sized dimples may adversely affect the aerodynamic characteristics of a golf ball, such as the lift and drag coefficient. In addition, as mentioned above, a mold is often used to form dimples on a cover. In order to simplify the mold manufacturing process, it may be desirable to limit the number of differently sized dimples. In one embodiment, the number of different dimple sizes is preferably about 15 or less. More preferably, the number of different dimple sizes is about 10 or less. Most preferably, the number of different dimple sizes is about 8 or less.

It may be desirable for the dimple pattern to include one or more dimples that overlap. One advantage of overlapping dimples is that the surface coverage of the dimple pattern may be increased. One example of a dimple pattern with overlapping dimples is described in co-pending U.S. application Ser. No. 10/737,812, filed Dec. 18, 2003, entitled "Golf Ball Dimple Pattern With Overlapping Dimples," the entirety of which is incorporated herein by reference.

Dimple patterns generated by the present invention achieves a high percentage of surface coverage. Surface coverage may be further increased based on overlapping dimples. In one embodiment, the present invention preferably generates a surface coverage of about 80% or greater. More preferably, the present invention generates a surface coverage of about 85% or greater. Most preferably, the present invention generates a surface coverage of about 90% or greater. In another embodiment, the present invention preferably generates a surface coverage of between about 80% and about 94%. More preferably, the present invention generates a surface coverage of between about 82% and about 90%. Most preferably, the present invention generates a surface coverage of between about 84% and about 87%.

According to one aspect of the present invention, dimples may be arranged such that at least a portion of neighboring dimples have predetermined diameter ratios. That is, at least some of the dimples are positioned in order to provide maximal diametrical disparity. Preferably, the diametrical disparity does not occur near the pole or near the equator. Rather, the diametrical disparity occurs substantially close to or around the midway point between the pole and the equator of a given hemisphere. The predetermined diameter ratios do not have to be the same for all of the neighboring dimples. Instead, the dimples may be arranged such that they comprise a one or more different diameter ratios. One advantage of at least a portion of the neighboring dimples having one or more predetermined diameter ratios is that the surface coverage may be increased. As used herein, diameter ratios refer to the ratio of the diameter of a larger dimple to the diameter of a smaller dimple.

With regard to one aspect of the present invention, the predetermined diameter ratios are determined based on nearest neighbor dimples. As used herein, nearest neighbor dimples are determined by first drawing two tangency lines from the center of a first dimple to a potential nearest neighbor dimple. In addition, a line segment is drawn connecting the center of the first dimple to the center of the potential nearest neighbor dimple. If there is no line segment that is intersected by another dimple, or portion of a dimple, then those dimples are considered to be nearest neighbors. Those skilled in the art will recognize that the line segments described above do not actually have to be drawn on the golf ball. Rather, it is desirable for the computer modeling program to be capable of performing this operation automatically.

Because the maximum and minimum size of the dimples may be predefined, as described above, possible diameter ratios may be limited. In other embodiments, however, the maximum and minimum sizes of the dimples may not be predefined. According to these embodiments, the diameter ratios may be larger than in embodiments where maximum and minimum diameters are predefined.

In one embodiment, the diameter ratios of at least a portion of nearest neighbor dimples is preferably between about 1.0 and about 2.5. More preferably, the diameter ratios of at least a portion of nearest neighbor dimples is between about 1.2 and about 2.0. Most preferably, the diameter ratios of at least a portion of nearest neighbor dimples is between about 1.4 and about 1.8. In another embodiment, the diameter ratios of at least a portion of nearest neighbor dimples is preferably about 3.0 or less. More preferably, the diameter ratios of at least a portion of nearest neighbor dimples is about 2.4 or less. Most preferably, the diameter ratios of at least a portion of nearest neighbor dimples is about 2.0 or less. In yet another embodiment, the diameter ratios of at least a portion of nearest neighbor dimples is preferably about 1.5 or greater.

More preferably, the diameter ratios of at least a portion of nearest neighbor dimples is about 2.0 or greater. Most preferably, the diameter ratios of at least a portion of nearest neighbor dimples is about 3.0 or greater.

The total number of dimples on the golf ball may also be varied according to the present invention. The total number of dimples may be based on, for example, the number of differently sized dimples, the maximum and minimum diameters of the dimples, the dimple arrangement, and the like. Preferably, the total number of dimples is between about 250 and about 500. More preferably, the total number of dimples is between about 340 and about 450. Most preferably, the total number of dimples is between about 375 and about 435.

Dimple patterns generated according to the present invention may be incorporated onto the surface of a golf ball. Any golf ball may be used, as described above. In one embodiment, golf balls that include an exemplary dimple pattern of the present invention comprise advantageous aerodynamic characteristics. One way to describe the aerodynamic characteristics of a golf ball is by the aerodynamic coefficient magnitude and the aerodynamic force angle. The aerodynamic coefficient magnitude is defined by, for example, $C_{mag}=\sqrt{(C_L^2+C_D^2)}$. The aerodynamic force angle is defined by, for example, $\text{Angle}=\tan^{-1}(C_L/C_D)$. In both of these equations $C_L$ is the lift coefficient, and $C_D$ is the drag coefficient. The aerodynamic coefficient magnitude and aerodynamic force angle account for both lift and drag simultaneously, and are described in U.S. Pat. No. 6,729,976, the entirety of which is incorporated herein.

Based on a dimple pattern generated as described above, a golf ball preferably achieves a $C_{mag}$ of between about 0.25 and about 0.28 and an Angle of between about 28 degrees and 40 degrees at a Reynolds Number of 230000 and a spin ratio of 0.080. In another embodiment, a golf ball that includes a dimple pattern according to the present invention achieves a $C_{mag}$ of between about 0.26 and about 0.29 and an Angle of between about 29 degrees and about 41 degrees at a Reynolds Number of 208000 and a spin ratio of 0.090. In yet another embodiment, a golf ball that includes a dimple pattern according to the present invention achieves a $C_{mag}$ of between about 0.26 and about 0.30 and an Angle of between about 30 degrees and about 42 degrees at a Reynolds Number of 190000 and a spin ratio of 0.10. In other embodiments, a golf ball that includes a dimple pattern according to the present invention achieves a $C_{mag}$ of between about 0.27 and about 0.32 and an Angle of between about 31 degrees and about 44 degrees at a Reynolds Number of 170000 and a spin ratio of 0.11.

Although some preferred embodiments have been described, many modifications and variations may be made thereto in light of the above teachings without departing from the spirit and scope of the present invention. It is therefore to be understood that the invention may be practiced otherwise than specifically described without departing from the scope of the appended claims.

The invention claimed is:

1. A golf ball surface including two hemispheres each having a pole, wherein to two hemispheres are divided by an equator positioned midway between the poles, wherein the surface comprises:

a dimple positioned at each pole; and six substantially similar mating dimple sections located on each hemisphere, wherein each dimple section has a dimple pattern comprising dimples selectively positioned such that at least a portion of nearest neighbor dimples have diameter ratios of about 1.5 or greater, and wherein the nearest neighbor dimples comprising a diameter ratio of about 1.5 or greater are selectively positioned around an area of each dimple section located midway between the equator and the pole of each of the two hemispheres and not near the equator.

2. The golf ball according to claim 1, wherein the six substantially similar mating dimple sections on each side of the equator share the dimple positioned at each pole.

3. The golf ball according to claim 1, wherein the dimple pattern has a surface coverage of about 82% or more.

4. The golf ball according to claim 1, wherein the dimple pattern comprises between about 250 and about 475 dimples.

5. The golf ball according to claim 1, wherein the nearest neighbor dimples have diameter ratios of about 1.8 or greater.

6. The golf ball according to claim 1, wherein each dimple section shares a polar dimple.

7. The golf ball according to claim 1, wherein the golf ball comprises a plurality of dimples having an aerodynamic coefficient magnitude defined by $C_{mag}=\sqrt{(C_L^2+C_l^D)}$ and an aerodynamic force angle defined by Angle $=\tan^{-1}(C_L/C_D)$, wherein $C_L$ is a lift coefficient and $C_D$ is a drag coefficient, wherein the golf ball comprises:

a first aerodynamic coefficient magnitude between about 0.25 and about 0.28 and a first aerodynamic force angle between about 28 degrees and about 40 degrees at a Reynolds Number of about 230000 and a spin ratio of about 0.080; and a second aerodynamic coefficient magnitude between about 0.26 and about 0.29 and a second aerodynamic force angle between about 29 degrees and about 41 degrees at a Reynolds Number of about 208000 and a spin ratio of about 0.090.

8. The golf ball according to claim 7, further comprising:

a third aerodynamic coefficient magnitude between about 0.26 and about 0.30 and a third aerodynamic force angle between about 30 degrees and about 42 degrees at a Reynolds Number of about 190000 and a spin ratio of about 0.10; and a fourth aerodynamic coefficient magnitude between about 0.27 and about 0.32 and a fourth aerodynamic force angle between about 31 degrees and about 44 degrees at a Reynolds Number of about 170000 and a spin ratio of about 0.11.

9. A method for arranging dimples on the surface of a golf ball, wherein the golf ball includes two hemispheres each having a pole, and wherein the two hemispheres are divided by an equator located midway between the poles, the method comprising:

positioning a dimple at the pole of each hemisphere; and ranging a plurality of dimples in a substantially similar manner within each of six identical substantially mating dimple sections positioned on each side of the equator, wherein:

the plurality of dimples comprises at least some dimples having one or more predetermined nearest neighbor diameter ratios of about 1.5 or greater, the at least some dimples having one or more predetermined nearest neighbor diameter ratios are not positioned near the pole or equator; and the plurality of dimples are arranged such that they have a surface coverage of about 80% or greater.

10. The method according to claim 9, wherein the one or more predetermined nearest neighbor diameter ratios are about 2.0 or greater.

11. The method according to claim 9, wherein the one or more predetermined nearest neighbor diameter ratios are between about 1.5 and about 1.8.

12. The method according to claim 9, wherein the plurality of dimples are arranged such that they have a surface coverage of about 85% or greater.

13. The method according to claim 9, wherein the golf ball comprises a plurality of dimples having an aerodynamic coefficient magnitude defined by $C_{mag}=\sqrt{(C_L^D+C_L^D)}$ and an aerodynamic force angle defined by Angle $=\tan^{-1}(C_L/C_D)$, wherein $C_L$ is a lift coefficient and $C_D$ is a drag coefficient, wherein the golf ball comprises:

a first aerodynamic coefficient magnitude between about 0.25 and about 0.28 and a first aerodynamic force angle between about 28 degrees and about 40 degrees at a Reynolds Number of about 230000 and a spin ratio of about 0.080; and a second aerodynamic coefficient magnitude between about 0.26 and about 0.29 and a second aerodynamic force angle between about 29 degrees and about 41 degrees at a Reynolds Number of about 208000 and a spin ratio of about 0.090.

14. The method according to claim 13, further comprising:

a third aerodynamic coefficient magnitude between about 0.26 and about 0.30 and a third aerodynamic force angle between about 30 degrees and about 42 degrees at a Reynolds Number of about 190000 and a spin ratio of about 0.10; and a fourth aerodynamic coefficient magnitude between about 0.27 and about 0.32 and a fourth aerodynamic force angle between about 31 degrees and about 44 degrees at a Reynolds Number of about 170000 and a spin ratio of about 0.11.

15. The method according to claim 9, wherein the plurality of dimples comprises between about 250 and about 475 dimples.

16. The method according to claim 9, wherein the plurality of dimples each have a diameter of about 0.08 inches or greater.

17. A method for arranging dimples on the surface of a golf ball, wherein the golf ball includes two hemispheres each having a pole, and wherein the hemispheres are divided by an equator located midway between the poles, the method comprising:

positioning a dimple at the pole of each hemisphere;

generating a dimple arrangement for a plurality of dimples within each of six similar substantially mating dimple sections positioned on each hemispheres wherein:

the six similar substantially mating dimple sections positioned on each hemisphere share the dimple positioned at the pole of the hemisphere; and the plurality of dimples comprises dimples having nearest neighbor diameter ratios of about 1.5 or greater positioned midway between the equator and the pole of each of the two hemispheres and not near the equator.

18. The method according to claim 17, wherein the nearest neighbor diameter ratios are about 2 or greater.

19. The method according to claim 17, wherein the plurality of dimples comprises a surface coverage of at least about 82%.

20. The method according to claim 17, wherein the nearest neighbor diameter ratios are between about 1.5 and about 1.8.

21. The method according to claim 17, wherein the golf ball comprises a plurality of dimples having an aerodynamic coefficient magnitude defined by $C_{mag}=\sqrt{(C_L^2+C_L^D)}$ and an aerodynamic force angle defined by Angle $=\tan^{-1}(C_1/C_D)$, wherein $C_L$ is a lift coefficient and $C_D$ is a drag coefficient, wherein the golf ball comprises;

a first aerodynamic coefficient magnitude between about 0.25 and about 0.28 and a first aerodynamic force angle between about 28 degrees and about 40 degrees at a Reynolds Number of about 230000 and a spin ratio of about 0.0808; and a second aerodynamic coefficient magnitude between about 0.26 and about 0.29 and a second aerodynamic force angle between about 29 degrees and about 41 degrees at a Reynolds Number of about 208000 and a spin ratio of about 0.090.

22. The method according to claim 21, further comprising:

a third aerodynamic coefficient magnitude between about 0.26 and about 0.30 and a third aerodynamic force angle between about 30 degrees and about 42 degrees at a Reynolds Number of about 190000 and a spin ratio of about 0.10; and a fourth aerodynamic coefficient magnitude between about 0.27 and about 0.32 and a fourth aerodynamic force angle between about 31 degrees and about 44 degrees at a Reynolds Number of about 170000 and a spin ratio of about 0.11.

23. A golf ball surface including two hemispheres each having a pole, wherein the two hemispheres are divided by an equator positioned midway between the poles, wherein the surface comprises:

a dimple positioned at each pole; and six substantially similar mating dimple sections located on each hemisphere.

wherein each dimple section has a dimple pattern comprising dimples selectively positioned such that at least a portion of nearest neighbor dimples have diameter ratios of about 1.5 or greater, and wherein the golf ball comprises a plurality of dimples having an aerodynamic coefficient magnitude defined by $C_{mag}=\sqrt{(C_L^2+C_L^D)}$ and an aerodynamic force angle defined by Angle $=\tan^{-1}(C_L/C_D)$, wherein $C_L$ is a lift coefficient and $C_D$ is a drag coefficient, wherein the golf ball comprises:

a first aerodynamic coefficient magnitude between about 0.25 and about 0.28 and a first aerodynamic force angle between about 28 degrees and about 40 degrees at a Reynolds Number of about 230000 and a spin ratio of about 0.080; and a second aerodynamic coefficient magnitude between about 0.26 and about 0.29 and a second aerodynamic force angle between about 29 degrees and about 41 degrees at a Reynolds Number of about 208000 and a spin ratio of about 0.090.

24. The golf ball according to claim 23, further comprising:

a third aerodynamic coefficient magnitude between about 0.26 and about 0.30 and a third aerodynamic force angle between about 30 degrees and about 42 degrees at a Reynolds Number of about 190000 and a spin ratio of about 0.10; and a fourth aerodynamic coefficient magnitude between about 0.27 and about 0.32 and a fourth aerodynamic force angle between about 31 degrees and about 44 degrees at a Reynolds Number of about 170000 and a spin ratio of about 0.11.

* * * * *